US006217487B1

(12) United States Patent
Reinert

(10) Patent No.: US 6,217,487 B1
(45) Date of Patent: Apr. 17, 2001

(54) QUADRUPED-TYPE EXERCISE APPARATUS FOR HUMANS AND METHOD OF EXERCISING

(76) Inventor: Richard W. Reinert, 671 Victoria Ct., Easton, PA (US) 18045-5275

( * ) Notice: Subject to any disclaimer, the term of this patent is extended or adjusted under 35 U.S.C. 154(b) by 0 days.

(21) Appl. No.: 09/139,464

(22) Filed: Aug. 25, 1998

(51) Int. Cl.[7] ..... A63B 22/00
(52) U.S. Cl. ..... 482/54
(58) Field of Search ..... 482/51, 54, 69

(56) References Cited

U.S. PATENT DOCUMENTS

| | | | |
|---|---|---|---|
| 219,439 | 9/1879 | Blend . | |
| 1,364,699 | 1/1921 | Brown . | |
| 1,766,089 | 6/1930 | Wood . | |
| 2,017,128 | 10/1935 | O'Neill, Jr. . | |
| 2,155,684 | 4/1939 | Richards . | |
| 2,506,322 | 5/1950 | Yushak . | |
| 3,637,206 | 1/1972 | Chickering, III . | |
| 4,204,673 | 5/1980 | Speer, Sr. . | |
| 4,342,452 | 8/1982 | Summa . | |
| 4,551,108 | 11/1985 | Bass . | |
| 4,743,008 | 5/1988 | Fermaglich et al. . | |
| 4,861,021 | 8/1989 | Edwards et al. . | |
| 5,100,127 | 3/1992 | Melnick et al. . | |
| 5,318,491 * | 6/1994 | Houston | 482/54 |
| 5,462,506 * | 10/1995 | Markland | 482/54 |
| 5,626,539 * | 5/1997 | Piaget et al. | 482/54 |

* cited by examiner

*Primary Examiner*—Glenn E. Richman
(74) *Attorney, Agent, or Firm*—Charles A. Wilkinson

(57) ABSTRACT

An apparatus and method is provided for quadrupedal exercise, i.e. exercise by walking or running on all fours in a manner similar to four-footed animals. The apparatus is composed essentially of a forward continuous tread and a rear continuous tread, in which the forward continuous tread is disposed at a higher level than the rear continuous tread, the relative heights of the two being adjusted so that when the hands of the user are placed upon the forward tread and the feet are placed on the rear tread, the angle of the body through the spine will be essentially horizontal, or a little greater than horizontal. In most cases, the tread for the hands or support of the upper portion of the body will be divided into two parallel treads while the tread for support of the feet will be a single tread positioned more or less in a central position with respect to the forward tread. A method of exercising involving movement relative to a two-level track is also disclosed.

22 Claims, 9 Drawing Sheets

Fig. 3A
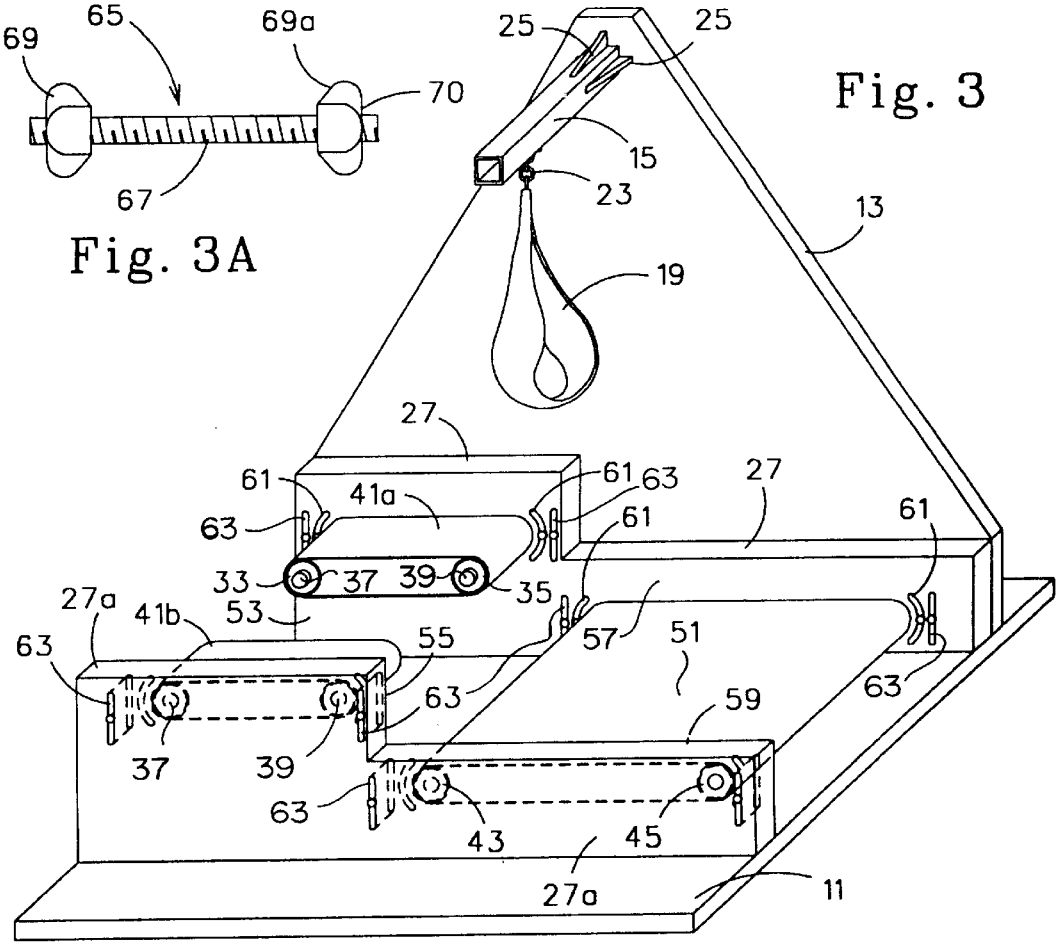
Fig. 3
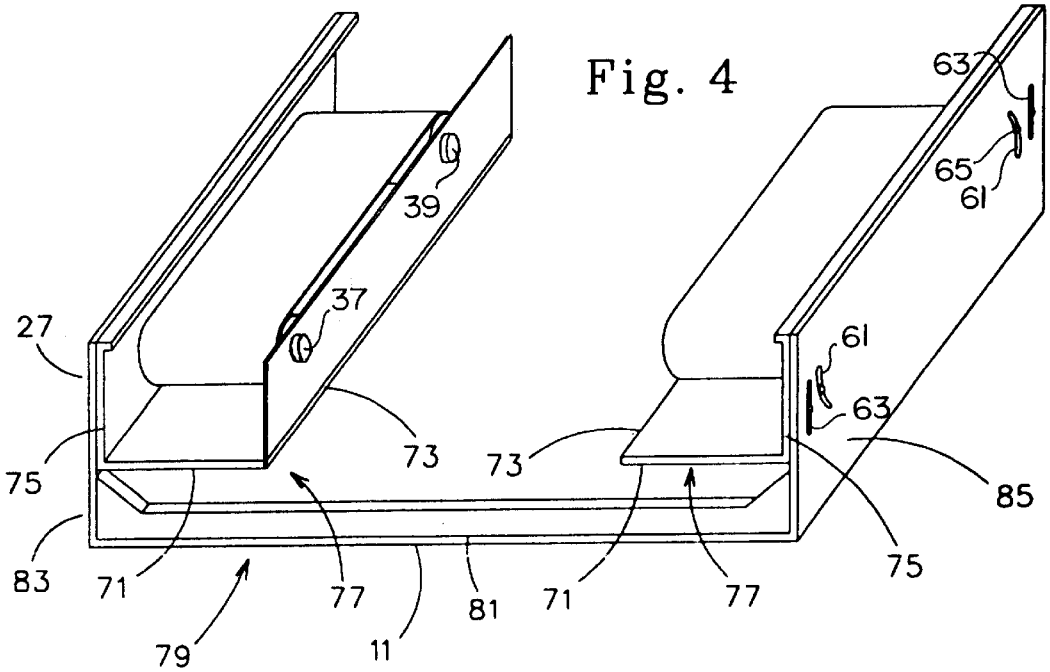
Fig. 4

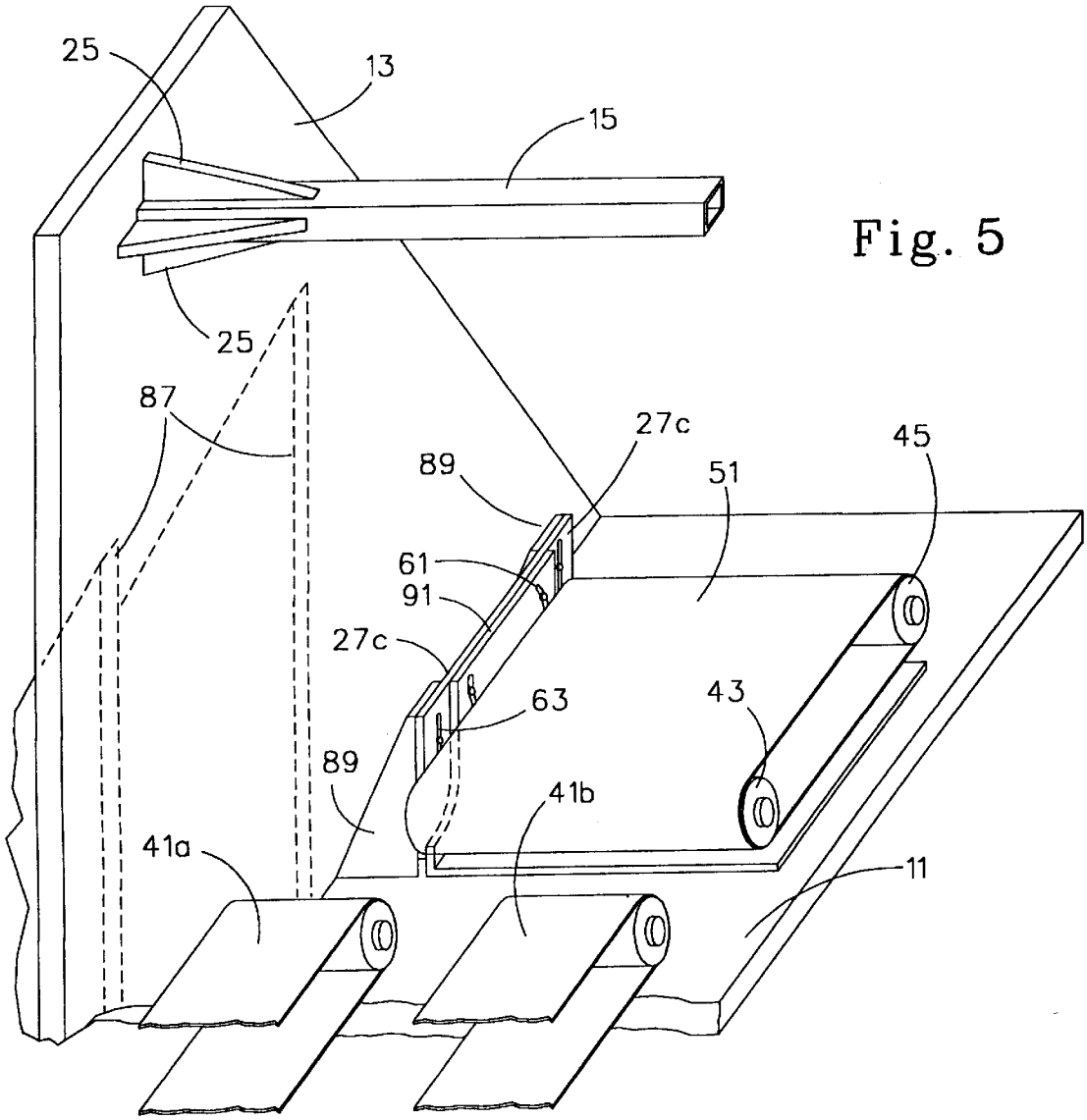
Fig. 5
Fig. 6
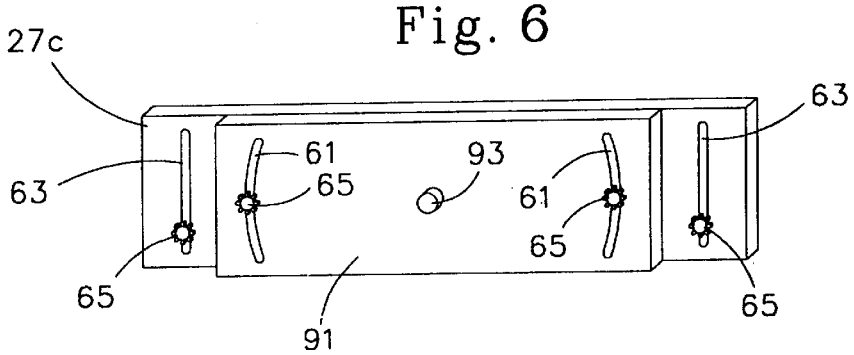

Fig. 13
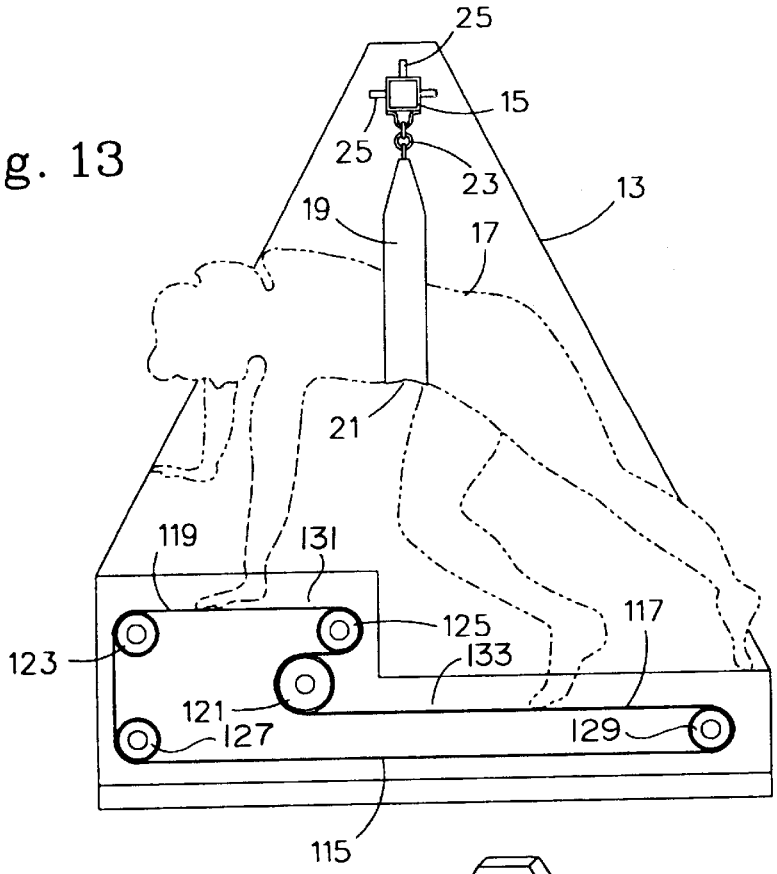
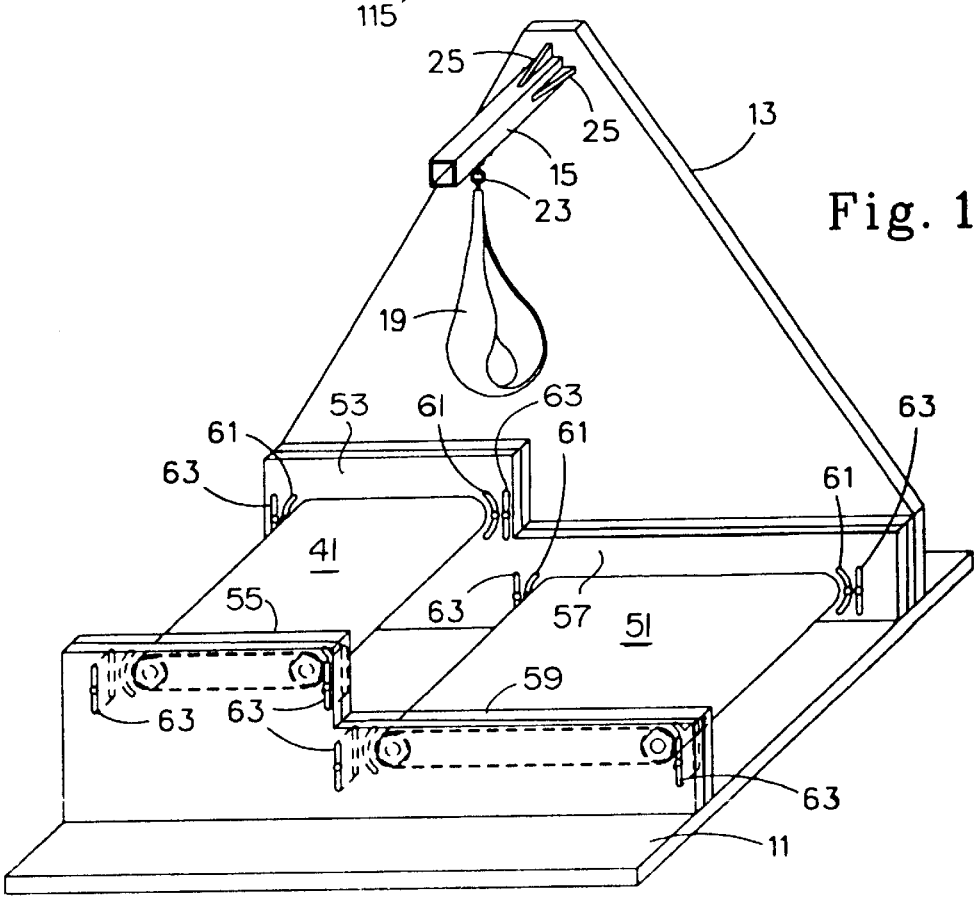
Fig. 14

QUADRUPED-TYPE EXERCISE APPARATUS FOR HUMANS AND METHOD OF EXERCISING

FIELD OF THE INVENTION

This invention relates to walking- or running-type exercise machines and more particularly to treadmill-type exercisers. More particularly still, the invention relates to a multiple treadmill-type exerciser configured to allow a human subject to assume the gait of a quadruped in order to burn calories more quickly and add interest to exercise routines, especially for children and the young at heart, as well as a method of exercising the human body in a quadruped manner.

DISCUSSION OF THE PRIOR ART

A plurality of machines have been developed to facilitate exercise in restricted and frequently inconvenient places and times, either at home or in commercial or educational institutions where both time and space may be at a premium. Among such apparatus may be running or walking treadmills, stationary bicycle-type machines, artificial stair climbing apparatus, often referred to as "steppers", simulated ski movement apparatus, weight-lifting apparatus and the like.

In the particular case of treadmill-type exercise equipment, exercise is obtained by walking or running in position on the piece of equipment, thus simulating normal walking or running on an indoor or outdoor track. Such treadmills usually comprise a rubberized support belt which is carried upon multiple axles which turn as the belt passes unidirectionally beneath the feet of the user. In most modern treadmills, the traveling belt is adjustable for various angles, and the support axles may be power driven for independent rotation without regard for the user, allowing such user to merely walk or run in place.

In a second, usually older-type, apparatus, the motion of the user will cause movement of the treadmill. Usually in these older treadmills, the user will grasp hold of side rails or the like so as to have a stationary point which is maintained constant relative to the belt, while the forward to back or back and forth motion of the legs of the user serves to keep the belt moving. In a variation of such apparatus, the user may be prevented or retarded from moving forward on the belt by a transverse waist-height bar over the belt, or by being tied or secured in place on the belt usually by a belt or fastening about the waist of the user which is secured to a post or the like on the base of the treadmill apparatus. In all such non-motorized apparatus, while the overall walking or running movement is less natural, more calories are expended in maintaining the motion so that more overall exercise is obtained by the user in any given period than by the use of a motorized treadmill.

In addition to the above, it is not unusual for a treadmill-type apparatus to be equipped with an arm exercise apparatus, especially of the weighted pulley-type, allowing the arms to be moved in unison with the striding legs. A more extreme form of such an arrangement is typically provided in ski-type exercisers where the alternate sliding forward and backward of the foot pieces or supports is typically accompanied by an opposite, but coordinated, tension on weighted cables attached to the hand grips or hand levers attached to spring biasing means, thus providing simultaneous whole body exercise.

Treadmill-type apparatus has also been provided for animals, such as dogs and racehorses, to provide exercise for such animals where running or walking in the open may not be practical or convenient. In some cases, the treadmills have incorporated separate belts for the legs of the animal on both sides. Frequently, the animal is strapped into position to keep it from wandering off, or, as in older human treadmill apparatus, to provide the restraint to forward motion that allows the movement of the animals feet to propel the treadmill itself. Alternatively, the treadmills themselves may be motorized to ensure continuous or uniform movement.

Modern treadmills are frequently adjustably angled or slantable in order to vary the effort required to operate them. For example, if the treadmill is slanted, the use of it simulates walking uphill because each forward step requires a step up followed by forcing the treadmill downwardly by the force of the legs in a similar manner to lifting the body by the force of the legs when actually climbing a hill. Medical stress test treadmills regularly use this feature to provide progressive degrees of exertion.

It has been frequently found to be difficult to provide exercise apparatus that will encourage relatively young or immature persons to begin with, as well as to stick to, an exercise routine because of the relative lack of interest inspired by the available equipment. Yet it can be quite important to instill an early inclination for exercise in young children to ensure such activity will be followed later in life.

A general survey of treadmill types may be obtained by reference to the following U.S. Patents directed to such apparatus:

U.S. Pat. No. 219,439 issued Sep. 9, 1879 to L. H. Blend discloses a passive-motion walking machine designed for therapeutic use for treatment of conditions such as paralysis and curvature of the spine by producing a passive motion similar to natural walking, and combined with the partial suspension of the patient's body by the waist or head by a pair of straps.

U.S. Pat. No. 1,766,089 issued Jun. 24, 1930 to A. J. Wood discloses a treadmill exercising device for simulating natural walking or running motions. The treadmill platform is composed of a plurality of supporting rollers on which a single endless tread belt is placed. The platform may be adjustably inclined to simulate uphill walking, and a pair of straps may be attached to a handrail and then loosely tied around the operator's waist to maintain the position and stance of the user.

U.S. Pat. No. 2,017,138 issued Oct. 15, 1935 to F. O'Neill, Jr. discloses a treadmill device with curved guides or flanges attached to both ends of a metal base on which a continuous belt is attached. A spring tension belt may be attached to a handrail and placed around the waist of the operator to give an upward lift to the abdominal organs.

U.S. Pat. No. 2,155,684 issued Apr. 25, 1989 to J. R. Richards discloses an animal exercising device of the treadmill variety in which the animal is strapped to a pair of guardrails or guide rails with a harness in a manner such that the animal may walk or run as appropriate as the inclination of the tread is adjusted.

U.S. Pat. No. 4,204,673 issued May 27, 1980 to J. Speer, Sr. discloses a treadmill exerciser having two separate treadmills adjacent each other with separate continuous treads.

U.S. Pat. No. 4,861,021 issued Aug. 29, 1989 to M. Edwards et al. discloses a safety harness on/off switch assembly for use with motorized treadmills in which a pair of interconnected straps are suspended from a support with loops on each strap to support the user.

U.S. Pat. No. 5,100,127 issued Mar. 31, 1992 to D. Melnick et al. discloses a complex, multipurpose exercise treadmill designed for quadrupeds, particularly racehorses. The device comprises a tripartite frame structure and treadmill floor surface provided with shock-absorbing means and a vertically-extending mast to which a belt adapted for use by a quadruped is attached.

While the various devices shown and described in the foregoing patents may be effective within the scope of their designs to provide various amounts of exercise to the users, there is actually a rather limited repertoire of movements and varieties of exercise available with various treadmill-type exercise machines. There has been a need, therefore, to provide exercise machines facilitating a greater variety of exercise movements. There has also been a need to provide an exercise apparatus that will embody various advantages including preferably having some inherent quality which may lead many people to test or try it, and eventually to use it or other equivalent apparatus on a regular basis.

In addition, while young persons have frequently imitated quadrupeds by walking or running like four-footed animals, sometimes with bent legs to avoid the elevation of their buttocks at an inconvenient angle, only the very young have been normally able to do so without such an awkward elevation of the buttocks due to the difference in the normal lengths of human legs and arms. On the other hand, movement of the body in a quadruped stance is a very effective way to obtain a thorough workout of the muscle system of substantially the entire body.

OBJECTS OF THE INVENTION

It is an object of the invention, therefore, to provide an exercise machine that will allow the user to proceed in the manner of a quadruped on the surface of such apparatus.

It is a further object of the invention to provide an exercise apparatus that provides separate moving treads for each of the four limbs of a user when the user adopts a quadruped gait.

It is a still further object of the invention to provide an exercise device of the treadmill-type that may be adjusted for various speeds of movement.

It is a still further object of the invention to provide an exercise apparatus that includes a support means to aid in support of the body of the user during sustained exercise.

It is a still further object of the invention to provide an exercise apparatus that will appeal to persons of all ages, particularly young persons.

It is a still further object of the invention to provide an exercise apparatus that provides a different movement, and exercises different muscles than other exercise apparatus.

It is a still further object of the invention to provide an exercise apparatus that is particularly effective in burning up calories while placing relatively little stress on the body's spine and joints.

It is a still further object of the invention to provide an exercise apparatus that exercises the entire body while placing minimal stress on the spine and joints.

It is a still further object of the invention to provide an exercise apparatus which stresses the muscles and provides abdominal support during motion.

It is a still further object of the invention to provide a novel method of exercising that gently stresses and exercises a majority of the muscles of the body while relieving stress and avoiding excess blood pressure elevation.

It is a still further object of the invention to provide a quadrupedal exercising device in which rear treads for the feet are positioned at a lower elevation than forward treads for receiving the hands of the user.

It is a still further object of the invention to provide a quadrupedal exercising device in which the forward treads for the hands are divided into two treads positioned forwardly but preferably partially overlapping a single rearward tread for the feet.

It is a still further object of the invention to provide a quadrupedal exercising device having a longitudinally moveable suspension belt suspension point over the treads.

Additional advantages and objects of the invention will become evident from review of the accompanying drawings in conjunction with the following description and discussion.

BRIEF DESCRIPTION OF THE INVENTION

A multiple tread apparatus is provided in which there are at least two endless moveable treads, one positioned at a higher level than the other, such that a user may be supported in a quadruped position upon said endless treads with the back, or spine, of the user aligned or held in a relatively straight, substantially horizontal position. The two treads may be operated either by the force of the user or may be separately mechanically operated by motors. There is also preferably provided a belt arrangement for passing around the abdomen of the user, partially supporting the user as well as maintaining the straight alignment of the abdominals. The belt is supported in any suitable manner from a boom arrangement, which is either part of the support for the endless belts or a separate arrangement placed adjacent to the apparatus. Preferably, the treads will be in the form of two adjacent upper treads to accommodate the hands of the user, and one lower tread to accommodate the feet for a total of three separate treads. However, two lower treads may also be provided for use separately by each leg for a total of four separate treads. The apparatus may be permanently situated in a position for use in a quadruped manner, either with the treads horizontal to the support surface upon which the apparatus rests, or with the treads angled upwardly to provide additional exercise. The hand support treads may also be arranged to be brought upwardly sufficiently so they will be adjacent to the user, or at the level of comfortable contact by the hands of the user, when in an erect position. A sliding arrangement may be provided for the suspension of the support belt to avoid pronounced pivoting of said suspended support if the user of the apparatus looses their balance or quadruped stride.

BRIEF DESCRIPTION OF THE DRAWINGS

FIG. 3 is an isometric side elevation showing the apparatus of the invention ready for use.

FIG. 3A is a side view of a jam-type screw fitting for use with the apparatus of the invention.

FIG. 4 is a frontal isometric view of a portion of the apparatus showing the support arrangement for the arm exercising belts of the invention.

FIG. 5 is a partial isometric view of one side of the apparatus illustrating the adjustment features for the foot tread belt, as well as the mounting of the boom arrangement.

FIG. 6 is a partial view of the support plates for the adjustable foot portion of the apparatus illustrating the interaction of the support plate and adjustable plate and their adjustment features.

FIG. 13 is a diagrammatic side elevation of an alternative embodiment as compared with that shown in FIG. 1, where the tread surface as a whole is comprised of one continuous belt rather than two.

FIG. 14 is a side perspective elevation of an alternative embodiment as compared with that shown in FIG. 3, where the hand tread surface is comprised of one continuous belt rather than two separate belts.

DETAILED DESCRIPTION OF PREFERRED EMBODIMENTS

Figure 1:
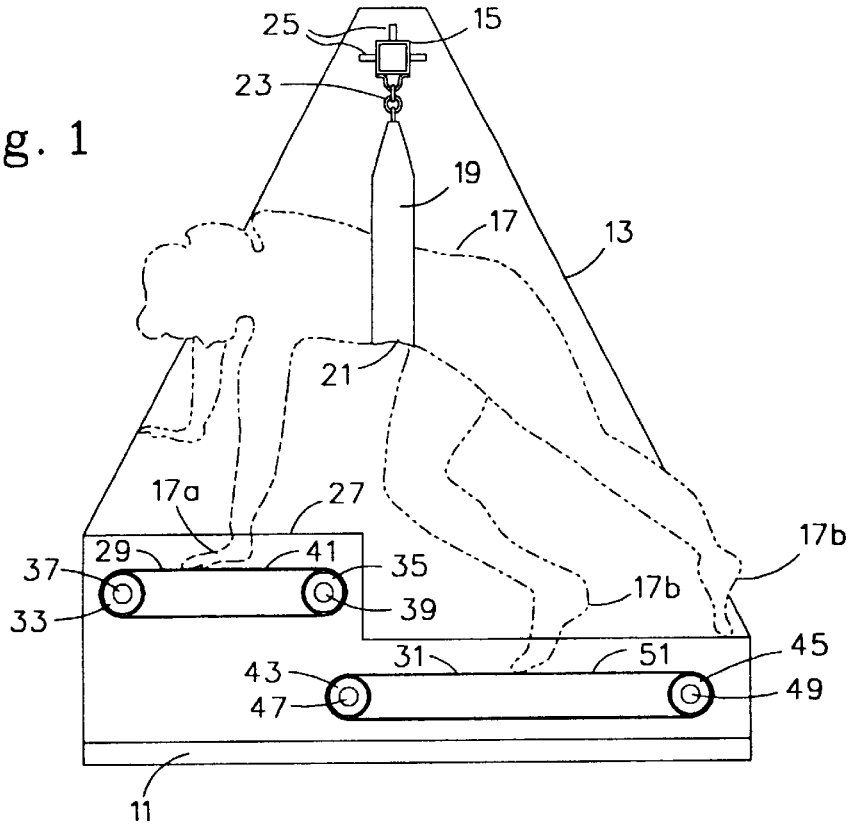
FIG. 1 is a partially cut away diagrammatic side elevation of the apparatus of the invention with a user, shown in phantom, supported from a belt arrangement over the tread apparatus.

A number of exercise apparatus have been invented in recent years to enable persons to obtain the regular exercise necessary for continuous good health and well being. Such exercising apparatus has fallen naturally into two main types, one to exercise the legs and the other to exercise the arms. One of the principal exercise apparatus for the legs is the treadmill, in which the user either walks, trots, or runs in place on a moving tread which is powered by either the motion of the user or a motor.

The other large use of exercise devices has involved various weights, springs, pulleys with weights, levers and the like for exercising the arms, wherein a handlebar or other handgrip or the like is grasped by the user and force, derived either from spring means or from weight means, is applied in opposition to the movement of the arms. While many of these prior exercise apparatus have been relatively sophisticated, all of them have the constraint that only certain muscles are used for each exercise routine available on the apparatus.

One of the most commercially successful total body exercisers for obtaining fairly vigorous exercise has been the so-called Nordic Track and its imitators. The legs and arms are simultaneously subjected to a back-and-forth movement, producing a total effect similar to the movements of a cross-country skier. However, even these popular apparatus have certain constraints with respect to the number of the muscles or muscle systems exercised during a given workout.

Another excellent exercise is swimming, wherein the amount of exercise is proportional to how vigorously the person swims. However, the difficulty with swimming is that a pool is not consistently and conveniently available to everyone. While certain sophisticated swimming devices in which the user swims against a predetermined variable current in a relatively restricted space are coming presently into use, these are available only to those who can afford access to them The benefit of swimming as an exercise is that it is almost impossible to injure the joints, although an occasional cramp may result from which recovery is usually fairly rapid.

The present inventor has realized that a high degree of intense exercise for both the muscles of the legs and the arms may be obtained if the subject exercises with the legs and arms while supported in a quadruped position. While such an exercise position and support arrangement may at first seem rather awkward, it is actually relatively natural, even for a human body, because the human bipedal body evolved from an intermediate quadrupedal form with only fairly minor changes in anatomy and physiology. Consequently, the quadrupedal stance may be assumed by humans in relative comfort when the correct apparatus is provided. The main difficulty for a human body in assuming a comfortable quadruped stance is the fact that the bipedal evolvement of humans has resulted in significantly longer legs than arms, so that in assuming a quadrupedal posture, the hips will normally be raised significantly over the shoulders and the head will be thrust downward in a rather uncomfortable position, from which, in an older person, it may even be difficult to look straight ahead unless the legs are maintained in an inconveniently bent position, in which position, however, they will be found to tire very rapidly. Thus, although treadmill apparatus have been designed for use by actual quadrupeds such as dogs, horses and the like, use of such animal treadmills are not comfortable for the usual bipedal human.

The present inventor realized that if two levels of treadmill belts are provided, one of which is above or more elevated than the other and forwardly disposed with respect to the other, that the legs may be easily accommodated on the rear belt while the hands may be comfortably accommodated on the forward belt, with the spine and the neck maintained in a fairly straight line. Even more comfortably, the treads for the arms may be moved upwardly resulting in a more comfortable, slight incline of the back or spine and resulting position of the head.

The present inventor, by studying the development of the human body whose ancestors had wide shoulders and narrow hips, has discovered while designing his two-part quadrupedal treadmill arrangement for humans, that the forward treadmill may be easily separated into two distinct treads displaced to the side and arranged outboardly of the treads for the legs. A preferred arrangement of a treadmill for a quadrupedal stance of a human, therefore, will have two separate hand support treads, positioned more or less outboard of, in front and at a higher elevation than the treads arranged for the legs.

Preferably in the arrangement of the invention, the various treads will be inclinably adjustable with respect to the floor as with normal treadmills. The forward and rear treads should also be vertically adjustable relative to each other to accommodate users with varying leg and arm dimensions and differences.

The invention allows the user to exercise almost all the muscles in his or her arms and legs, as well as many other bodily muscles, and the vigorousness of such exercise is also variable with respect to the user's exertion. A support belt is provided, preferably used about the middle of the user, to partially relieve the weight of the major portions of the body from the arms and legs, as well as to hold the user fairly stationary with respect to any forward or backward motion, allowing exercise to occur in a more relaxed manner. In addition, the belt tends to restrain the abdominal section of the body, preventing this area from sagging and allowing the muscles to work more efficiently.

The apparatus of the invention, therefore, has many advantages, only some of which have been set forth above. A better understanding of the invention will be garnered from study of the attached drawings in connection with the following description keyed to said drawings.

FIG. 1 is a diagrammatic partially cut away side elevation showing in phantom a human figure making use of a quadrupedal exercising apparatus in accordance with the invention. In FIG. 1, a base 11 has mounted thereupon a side support plate 13, which is shown, for convenience, as a triangular plate attached to one side of the base 11. It will be understood that the side support plate 13, while shown as a unitary plate, may be in the form of a discontinuous plate or even a framework extending upwardly to a point at which a laterally extending boom 15 may extend from the plate 13. It will be understood that the boom 15 extends outwardly towards the observer over the top of the user, represented by the human FIG. 17, who is supported or partially supported from a belt 19 which wraps around the central portion, or waist 21, of the user of the apparatus and is secured at the top to an eyelet-type support coupling 23 which secures the belt 19 to the boom 15. Braces 25 extend on all sides of the boom 15 near the support plate 13 and serve to support or stabilize the boom 15 in its outwardly extending position. See FIG. 2. At the lower portion of the side support plate 13, and also attached to the base 11, is a second sturdy support plate 27 to which the side support plate 13 is attached, and which extends upwardly from the base 11 an adequate height to support the tread apparatus 29 and 31. There are two hand tread apparatus 29 for contact with the hands 17*a* of the user, the second set 29*a* being supported by a support plate 27*a,* not shown in FIG. 1, but shown in FIG. 2, and one foot tread apparatus 31 for support of the user's feet, one side of which foot tread apparatus is supported by support plate 27 and the other side by support plate 27*a.* Each of the tread apparatus 29 and 29*a* are comprised of support roles 33 and 35, journaled on shafts 37 and 39 which are suitably rotatably journaled in the support plates 27 or 27*a* so that they extend horizontally out from such plates 27 and 27*a.* It should be understood that the axles 37 and 39 may normally be journaled, not only at the one end in the support plate 27, but in a similar support plate, not shown, or other support arrangement on their opposite ends so that the journals are supported on both ends for more security and vibration-free movement. Such axles may also be journaled, however, only at one end as shown particularly in FIG. 2. About the rollers 33 and 35 is wound, or passes, a flexible tread 41 which will be moved in an endless loop about the support rollers 33 and 35. The travel or movement of the tread 41, which is preferably a rubberized, flexible tread, may be caused either by the backward pressure of the hand 17*a* of the user 17, or by suitable motorization of the rollers 33 and 35, not illustrated in FIG. 1, but represented in FIG. 2 by the motors 46, the shafts of which pass through or are journalled in the support plates 27 and 27*a* and are secured to one of the axles 37 and 39 of the rolls 33 and 35.

Also journaled on the support plates 27 and 27*a* are two lower rollers 43 and 45 journaled on axles 47 and 49 in a position such that a flexible tread 51 passed about the rollers 43 and 45 will contact and support the feet 17*b* of the user 17. In a manner similar to the flexible hand tread 41, the flexible foot tread 51 may be driven about the rollers 43 and 45 either by the backward pressure of the feet of the user 17 or by motorized means, not specifically shown in FIG. 1, but similar to the motorization of any conventional tread machine and shown diagrammatically in FIG. 2 by belt connection 60*b* from motor 46 through journal extension 47.

Figure 2:
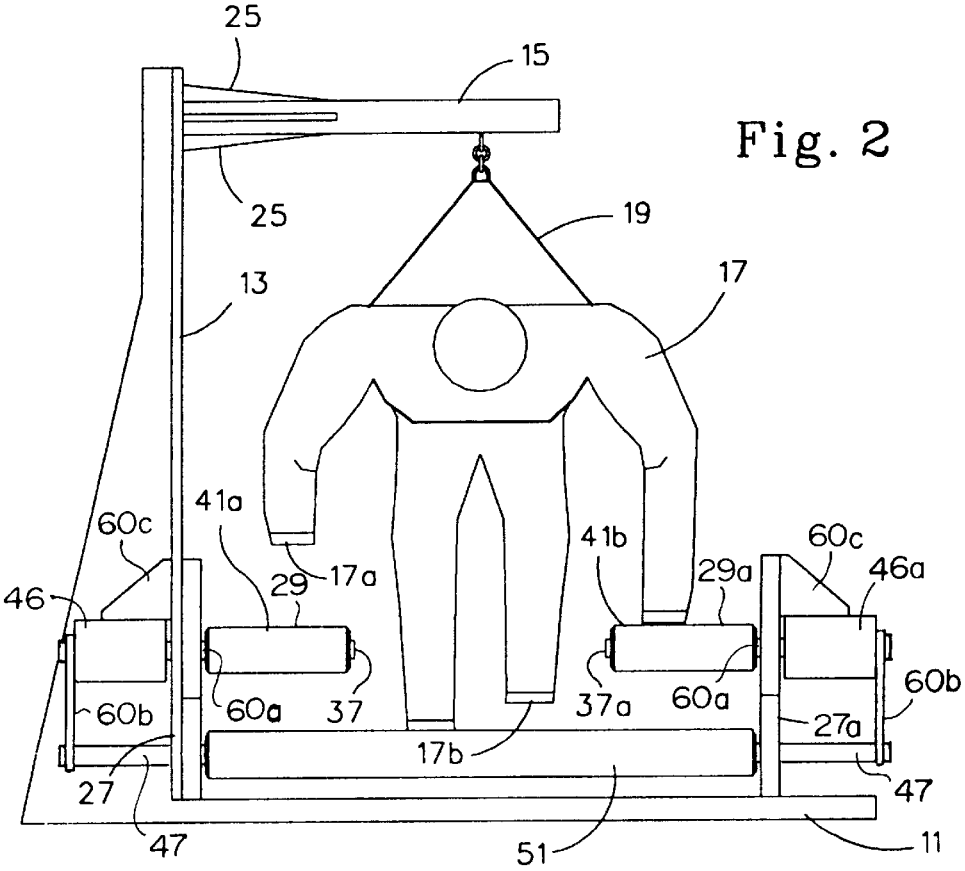
FIG. 2 is a diagrammatic front elevation showing the apparatus shown in FIG. 1 in use.

FIG. 2 is a diagrammatic front elevation of a preferred embodiment of the apparatus shown in FIG. 1. In such preferred embodiment, the tread 41, is divided with respect to the user 17 into a right portion 41*a* and a left portion 41*b,* where tread 41*a* is supported upon the journals 37 and 39, see FIG. 1, which are in turn journaled in support plate 27, and in the case of tread 41*b,* are supported on the journals 37*a* and a rear journal not shown, but similar to journal 39 shown in FIG. 1, which are in turn rotatably journaled in the support plate 27*a.* Likewise, the tread 51 is supported on journals 47 and 49 which are supported on both sides in the support plates 27 and 27*a.* It will be understood that the two treads 41*a* and 41*b* could also be in the form of a single tread which would extend between the plates 27 and 27*a* in a manner similar to the foot tread 51, since as can be seen in FIG. 1, the two treads 51 and 41 are displaced not only with respect to elevation, but with respect to longitudinal position on the base 11 so that the upper tread 41 will not interfere with use of the lower tread 51, even if the tread 41 extended all the way across the apparatus. However, since the evolution of the human body demonstrates a broad shoulder girdle, effectively positioning the hands and arms relatively displaced to the side, it is convenient to use two treads as shown, i.e. as two separate treads 41*a* and 41*b,* to support the arms of a user and only one or a single tread to support the legs of the user, since the feet are usually placed fairly close together not only on the human body, but also on any supporting surface. However, it will be understood that the foot tread could also be designed with two independently operating surface treads, even though the two tread sections would be placed closer together than the hand treads. Thus, while it is convenient to construct the apparatus with two upper treads designed for the hands and with a single foot tread designed to support and move with the feet of the user, it will be understood that either the hand treads could be designed to be a unitary tread, or the foot treads could be designed to be bipartite, or in two parts, similar to the preferred arrangement of the hand treads. Thus the design of the apparatus which is based ultimately upon the anatomy of the user, can be varied and still remain operative. The principal requirement is that the forward hand tread be arrangeable so that it is relatively higher than the foot tread thereby allowing for the relatively shorter arms of the normal human body with respect to the legs, and allowing the body itself to assume a relatively horizontal position when using the exercise device of the invention. The treads 41*a,* 41*b* and 51 may be motorized to travel or move automatically by means of the motors 46 and 46*a* shown in FIG. 2, each of which is attached to the journals 37 and 37*a* and 47 of the tread supporting rolls by couplings 60*a* or drive belts 60*b.* The motors 46 and 46*a* are also each supported by motor mounts or brackets 60*c* secured to the support plates 27 and 27*a.*

FIG. 3 is an isometric view of the apparatus of the invention showing the two treads 41*a* and 41*b* rotatably supported from the support plates 27 and 27*a,* while the single lower rearwardly positioned tread 51 is supported on rollers 43 and 45, which are in turn, rotatably supported from the side plates 27 and 27*a.* Portions of the treads 41*b* and 51 are shown in phantom behind the supporting plate 27*a*. It will be understood that the journaling of the rollers 33 and 35 will be relatively securely supported when journalled upon only one side, i.e. in the support plate 27. However, the ensuing wear may also be relatively severe in the journals and such wear could be decreased by extending the journalled rollers 37 and 39 across from the one tread 41*a* to the other tread 41*b*. This would not interfere with the operation because the legs of the user contact the tread 51 of the apparatus well behind the journals 37 and 39. There are also shown in FIG. 3, additional adjusting plates 53, 55 and 57, and 59 respectively, for the hand treads 41*a* and 41*b* and the foot tread 51. A further adjusting plate 59 on the near side of the apparatus for the foot tread is also shown along its upper and right-handed sections. The adjustment plates 53, 55, 57 and 59 are provided with curved slots in their surfaces, so that if one end of the plates 53 through 59 is raised with respect to the other end, that is to say with a pivoting movement, the slot will allow the far end to pivot. This allows the relative inclination of the treads 41*a*, 41*b* and 51 to be adjusted, primarily from a horizontal to an inclined position. At the same time, adjacent slots 63 are provided in the outside support plates 27 and 27*a*. Jam-type fastenings 65, shown in FIG. 3A, having a central externally threaded section 67 and internally threaded end caps 69 and 69*a* with wings or finger tabs 70 on their surfaces to facilitate tightening or untightening, pass through the opposed curved slots 61 and straight slots 63. See, in particular, FIG. 6. When the jam-type fastenings 65 are loosened on both sides of the apparatus, the adjustment plates 53 and 55, 57 and 59, may be moved relative to the support plates 27 and 27*a*. If it is desired to move the entire tread sections 41*a*, 41*b* or 51 up or down, the jam-type fastening 65 will be moved upwardly or downwardly in the straight slots 63 in the support plates, thus adjusting the relative heights of the two sets of treads 41*a* and 41*b* and 51. If it is desired to slant the tread surfaces 41*a*, 41*b* or 51 from one end to the other so that one end is higher than the other, only one end of the adjustment plates 53, 55, 57 or 59 will be moved in an arc corresponding to the curvature of the curved slots 61. Thus, the apparatus as shown in FIG. 3 allows adjustment of the tread surfaces to adapt to the size of the person who will use the apparatus, the relative length of their legs and arms, and also allows the slope of the treads to be adjusted so that the intensity of the exercise may be varied. In FIG. 3, the bottom plane or lower surface of the adjusting plates 53 and 57 and the outer end of plate 59 are shown with an arcuate curvature at their two lower extremities 62 to allow them to be more easily tilted to an angle in accordance with the arcuate shape of the adjustment slots 61.

As will be understood, the arrangements shown in FIG. 3, while effective with respect to adjustment of the treads and support of the treads, places a relatively large force upon the journals of the hand treads 41*a* and 41*b* because the rolls 33 and 35 are supported only at one end, causing a large moment of turning movement or twisting upon the journals.

It will also be recognized that the relatively simple arrangement shown in FIG. 2, for example, for connecting the shafts of motors 46 to the shafts of the rolls 33 and 35 and 43 and 45 may have to be modified in order to effectively keep the motors aligned with the shafts of the rolls. Ways of accomplishing such alignment will occur to those skilled in the art.

FIG. 4 shows an improvement in the arrangement to support the journals of the rolls in which both ends of the journals may be supported. In this arrangement, the adjustment plates 53 and 55, rather than being merely flat plates, are formed as channels 77 having an inside section, or flange, 75, a lower section, or web, 71 and a far section, or flange, 73, into which outer journals of the rolls 33 and 35 may be passed to provide overall greater support for the rolls. The arrangement, therefore, provides a channel 77 to support each hand tread. The inside section, or flange, 75 of these channels 77 is still mounted on the support plates 27 and 27*a* in the same manner as the adjustment plates 53 in FIG. 3 so that the treads may be adjusted either up and down or their inclination may be adjusted as explained with respect to FIG. 3. However, FIG. 4 depicts a much sturdier arrangement of the mechanical aspects of the apparatus. FIG. 4 also shows a further unitary construction, wherein the base plate 11 shown in FIGS. 1, 2 and 3 is part of a larger channel 79 which comprises the base 11, indicated here as 81, as well as the two sides 83 and 85, which constitute the equivalents of the two support plates 27 and 27*a*.

FIG. 5 is a partially broken-away figure showing an alternative arrangement for construction of an adjustable foot treadmill apparatus. Shown is a side support plate 13 supporting the boom 15 and extending down to the base 11. Shown partially in phantom and partially broken away are two triangular balancing support members 87 which extend on the outside of the side support plate 13 to add greater stability to the entire apparatus and prevent any possibility of it tipping over to the side. Instead of having the support plate 27 mounted directly against the side support plate 13, as shown in FIG. 3, in FIG. 5, the support plate 27, indicated as 27*c*, is mounted upon two brackets 89, which are attached to the base or inside surface of the base 11. The side support plate 27*c* is preferably attached to the brackets 89 via jam-type fittings 65 shown in FIG. 3A via the straight slots 63 so that the support plate 27 may be moved upwardly with respect to the brackets 89 to adjust the relative height of the foot tread 51 with respect to the other treads 41*a* and 41*b*, shown in FIG. 5 partially in section or broken off, to establish their relative positions. Meanwhile, an adjustment plate 91 is mounted adjacent to the support plate 27*c* through curved slots 61, which allow the adjustment plate 91 to be inclined with respect to the support plate 27*c*. Jam-type fittings 65 shown in FIG. 3A will attach the plate 91 to the support plate 27*c* to allow relative adjustment of the two plates and the opposite side of the foot tread 51 will be supported in the same manner as the side shown in FIG. 5. As will be evident in FIG. 5, it would not be inconvenient for the foot tread 51 to extend all the way across the apparatus, since the feet are relatively close together in their placement upon the ground or a suitable tread, unlike the hand treads 41*a* and 41*b* which need to be fairly wide apart.

FIG. 6 shows a further diagrammatic view of the generalized adjustment arrangement shown in the other drawings and particularly FIG. 5 in which an outer support plate 27*c* is provided with straight slots 63 in which a jam-type fitting 65 is placed. The support plate 27*c* may be moved upwardly or downwardly with respect to an outer frame such as, for example, the side support plate 13 or the brackets 89 as shown in FIG. 5. In FIG. 6 there is also shown an adjustment plate 91 which is held contiguous to the support plate 27*c* by further jam-type fastenings 65 in slots 61 which are curved slots allowing the adjustment plate 91 to be inclined with respect to the support plate 27*c*. There is preferably a pivot 93 in the center of the adjustment plate 91 about which the plate 91 can be pivoted, as allowed by the curved slots 61. Such pivot arrangement more securely fastens the adjustment plate 91 to the support plate 27*c* while allowing the adjustment plate to be pivoted any desired angle with respect to the support plate and allows either the hand treads or the foot treads to be inclined at any desired angle to either increase or decrease the force necessary to exert upon the treads to turn them or the exercise involved in keeping up with their movement, if the treads are motor driven. It will be noted that the embodiment of adjustment arrangement shown in FIGS. 5 and 6 include a vertical adjustment by vertical adjustment of support plate 27*c,* and adjustment plate 91 is arcuately adjustable on the support plate, while in the embodiment of FIG. 3, the adjustment plates 53, 55, 57 and 59 are both vertically and arcuately adjustable on stationary support plates 27.

Figure 7:
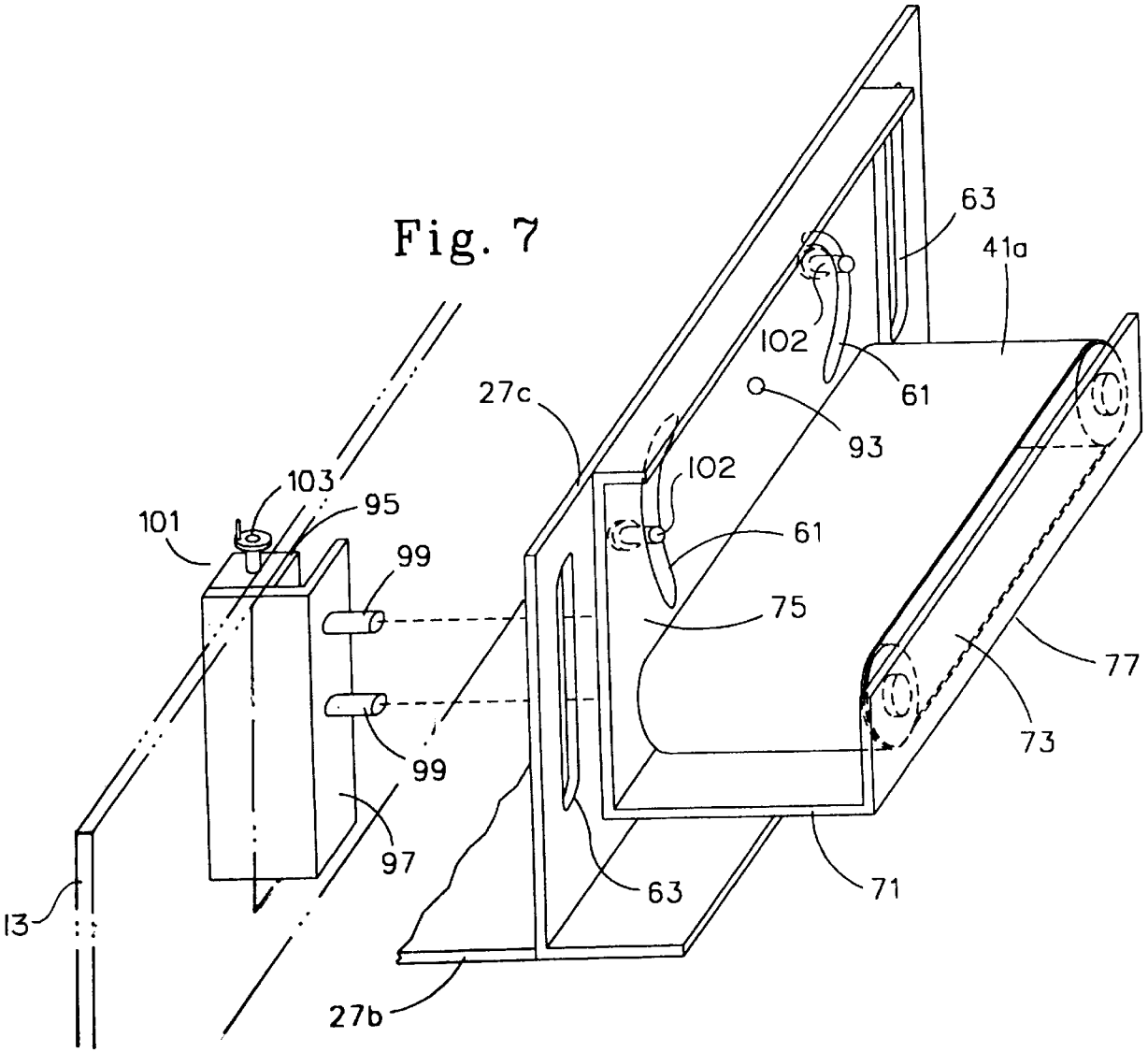
FIG. 7 is an isometric view of an alternative, partially disassembled support arrangement for one of the adjustable hand belts of the invention.
Figure 8:
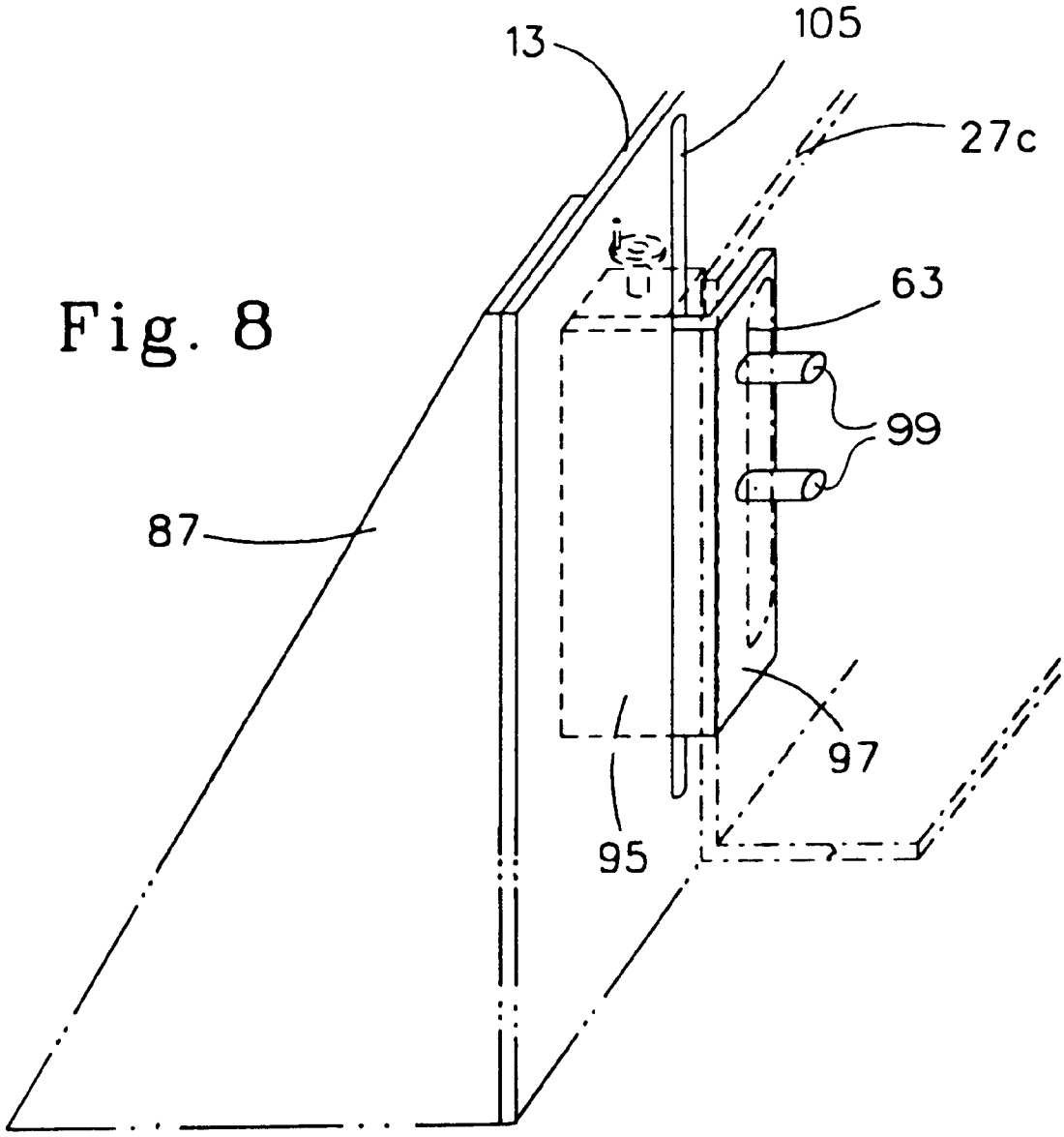
FIG. 8 is an isometric view, partially in phantom, illustrating an alternative arrangement for adjustment of the hand belts of the invention.

FIG. 7 shows a further alternative embodiment of the invention in which the support plate 27*c* is supported on two pins of a fitting 95 which is disposed on the rear surface of the side support plate 13, not shown, but as shown in FIG. 5, and has an adjustment screw 101 passing through the center for contact with a lower flange member 27*b* on the side of the side support plate 13. The adjustment screw 101 may be rotated through handle 103. A flange member 97 having an L-shape extends from the side of the fitting 95 and is adapted to pass through a slot, not shown, in the side support plate 13, which is also not shown, in FIG. 7, but is shown in FIG. 8 with the inside of the fitting 95 shown in phantom attached to the rear of the support plate 13 by a bracket, not shown, with the flange 97 extending through a slot 105 in the plate 13. The adjustment screw 101 will be understood to pass in a screw threaded arrangement with the bracket, not shown, so that when the adjustment screw 101 is rotated, the entire fitting 95 is moved either upwardly or downwardly upon the support plate 13. The flange 97, which extends through slot 105 in side support plate 13 shown in phantom has two pins 99 on its outer surface, which pins are extended through a straight slot 63 in the surface of the outer support plate 27*c*. It will be understood that the pins 99 will have on their ends jam fittings or securing means, not shown, which may be jammed against the surface of the plate 27*c* in order to hold such plate at any given height or position on the pins 99. When the fitting 95 is moved up and down by means of the screw threaded adjustment screw or member 101, the pins 99 on the flange 97 are also moved up and down, and if the support plate 27*c* is attached by jam-type fastenings 65 upon the pins 99 to the flange 97, the support plate 27*c* will also be moved up and down. Furthermore, since the support channel 77 is pivoted at 93 to the support plate 27*c,* loosening of similar jam-type adjustment fittings 65 on screw threaded members 102 in the curved slots 61 will enable the entire support channel 77 to not only be adjusted in height but also to be inclined at various angles so that the hand treads 41*a* and 41*b* will also be inclined. Consequently, it will be seen that the construction shown in FIGS. 7 and 8 enables the hand treads to be moved upwardly and downwardly to any desired position by merely turning the knob 103 of the adjustment screw 101, as well as inclined to any angle about the pivot 93.

FIG. 8 diagrammatically shows the arrangement of FIG. 7 with the support plate 27*c* shown in phantom rather than the side support plate 13 which is shown in FIG. 8 in full outline with the flange 97 of the fitting 95 extending through the slot 105 so that the flange is positioned on the inner side of the support plate 13 in a position such that the pins 99 may fit through a further slot 63 in the support plate as indicated in FIG. 27*c*. The slot 105 provided in the side support plate 13 enables the fitting 95 to be easily moved up and down by means of the screw mechanism 101 to any preferred position within the length of the slot 105. It will be noted in FIG. 8 that the use of the arrangement shown provides additional up-and-down adjustment since there are two slots, the first slot 105 in the side support plate 13 and the second straight slot 63 in the support plate 27*c*. FIG. 8 shows a slightly different embodiment than FIG. 7 in that instead of threaded member 99 upon which the jamb nuts 69 as shown in FIG. 3A and 6 may be threaded being mounted on flange 97 and extending through a slot 63 in the support plate 27*c,* the threaded members 99 are mounted upon the support plate 27*c* and extend through a slot 63 in the flange 97 which passes over the end of the support plate 27*c*. The result is the same as jamb nuts 69 when mounted upon the threaded members 99 whether mounted upon support plate 27*c* or flange 97 tightly tie the two members together. The adjustment of the support plate 27*c* with respect to the side support plate 13 is in both cases the same by the adjusting screw 101 while the adjustment within the slot 63 is by means of loosening and tightening the jam fittings 65, not shown, upon the pins 99. However, apparatus associated with the slot 63 might also be equipped with a screw-type adjustment so that adjustment at the slot 63 might also be made by means of a screw-type fitting. It will also be understood that rather than having two adjustment slots 63 and 105, either one of those slots could be lengthened to provide additional adjustment, provided that the structure in which the slot is positioned is wide enough to provide a longer slot. The arrangement shown specifically either FIG. 7 or in FIG. 8 provides additional adjustment over that which can be obtained by only one slot, particularly if the structures in which the slots occur are not particularly wide.

Figure 9:
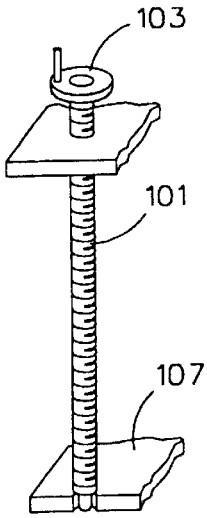
FIG. 9 is a partial isometric view of a screw thread adjustment for use in adjusting the elevation of the hand treads of the apparatus of the invention.

FIG. 9 shows a detail of the adjustment screw 101 and its rotating head 103 with the screw mounted in the one flange of the fitting 95, not shown, in the bottom of the screw extending into a seat in a bottom flange 107 of the apparatus.

Figure 10:
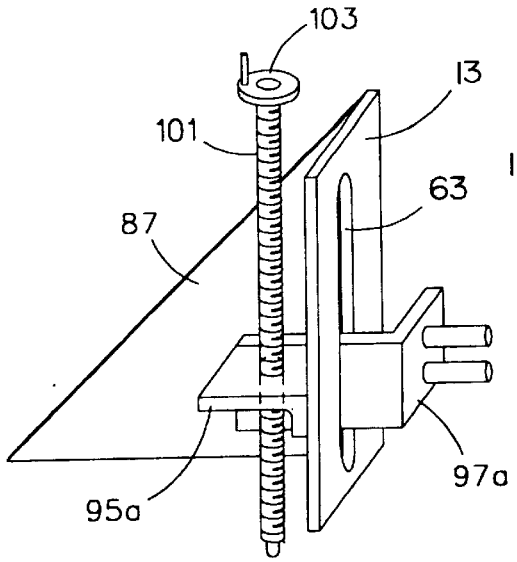
FIG. 10 is a further detail of the arrangement shown in FIG. 9.

FIG. 10 shows a further detail of the arrangement shown in FIGS. 8 and 9 with a somewhat different fitting 95*a,* one flange 97*a* of which extends through the slot 105 in a side support plate 13 which could also be a slot in a basic support plate 27*c*.

Figure 11:
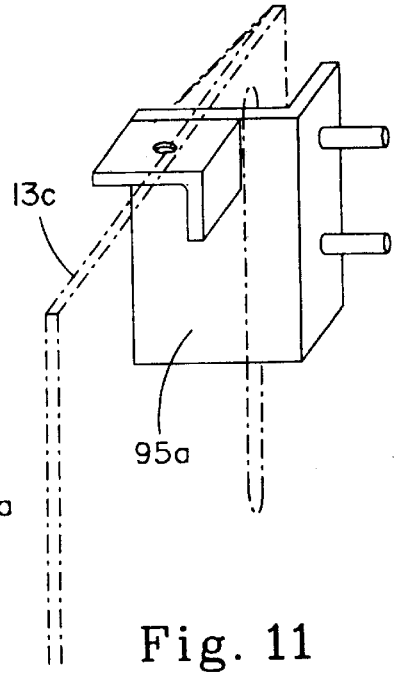
FIG. 11 is a further detail of an alternative to the arrangements shown in FIGS. 9 and 10.

FIG. 11 is an enlarged detail of the alternative embodiment of the fitting 95*a* shown in FIG. 10 with the flange 97*a* passing through the slot 63 in the support plate 13 with the side support plate 13 shown in phantom as in FIG. 7.

Figure 12:
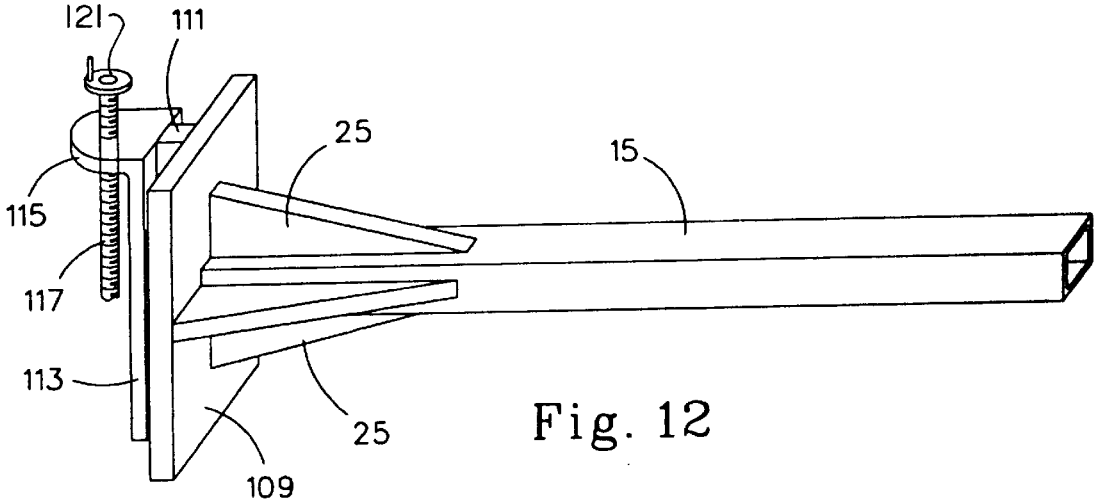
FIG. 12 is an enlarged isometric view of an adjustable arrangement for the boom of the invention.

FIG. 12 is an enlargement of an improved arrangement of a mounting for the boom 15 upon the side support plate 13, in which a boom support plate 109 is attached by welding or the like to the base of the boom 15 and braces 25. The boom support plate 109 has on the rear surface a narrow plate connecting slot plate 111 which connects to a slide plate 113 having a flange 115 at the top through which may be threaded an adjustment screw 117. The slot plate 111 is adapted to slide in a slot, not shown, in the side support plate 13, also not shown in FIG. 12, and the adjustment screw 117 and head or handle 121 allow the boom assembly to be slid to position in a slot, not shown, in the support plate 13, also not shown, the arrangement being more or less similar to that shown for the adjustment mechanics illustrated in FIGS. 8 through 11 for the vertical adjustment of the support plate 27*c*.

FIG. 13 is a diagrammatic side elevation showing an alternative arrangement of the tread apparatus of the invention from that shown in FIG. 1. In FIG. 1, the treads for the hands are separate and distinct from the treads for the feet. In FIG. 13, a singular-type tread 119, forming a continuous loop, is supported by the rolls 121, 123, 125, 127 and 129. The hands of the user 17 contact the upper section 131 of the tread, while the feet contact the lower section 133 of the tread.

FIG. 14 is an isometric embodiment similar to FIGS. 1 and 3, but providing a single hand tread 41. Jam-type fastenings 65, shown in FIG. 3A, will be moved upwardly or downwardly in the straight slots 63 in the support plates as in FIG. 3, thus adjusting the relative heights of the two treads 41 and 51. If it is desired to slant the tread surfaces 41 or 51 from one end to the other so that one end is higher than the other, only one end of the adjustment plates 53, 55, 57 or 59 will be moved in an arc corresponding to the curvature of the curved slots 61. Rounded off lower edges or corners 62 allow the adjustment plates 53 to be moved arcuately without jamming against the bottom plate 11.

Figure 15:
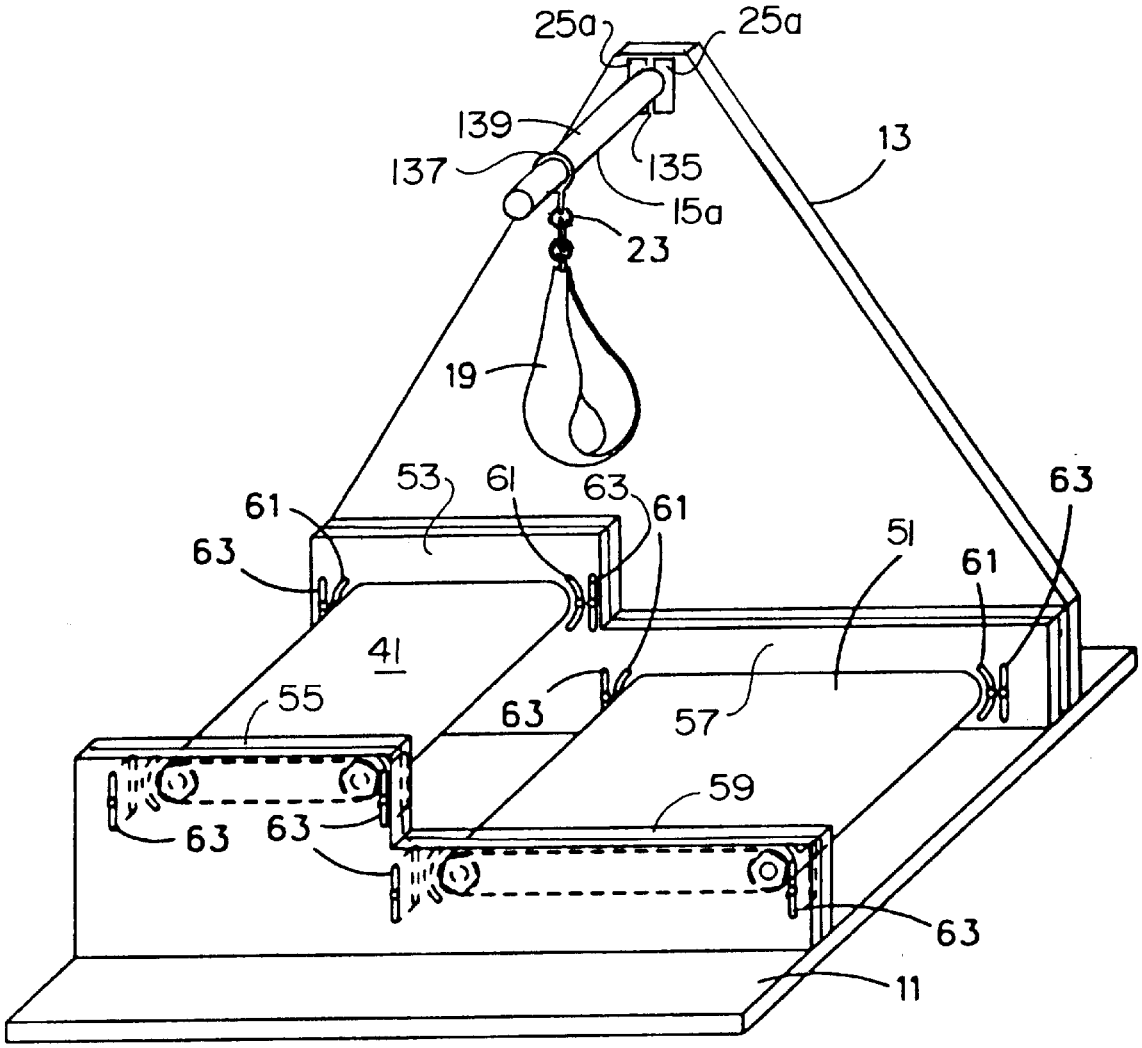
FIG. 15 is an isometric view of an alternative embodiment of the invention having a pivoting boom and slide attachment for the supporting belt to provide some longitudinal adjustment potential for the belt.

FIG. 15 shows a diagrammatic representation of an alternative embodiment of the invention, in which instead of the user of the apparatus being partially supported and suspended from a centralized boom which, while it may be adjustable height-wise is not adjustable longitudinally, instead uses a boom arrangement that may adjust at least somewhat or partially to longitudinal movement. In the embodiment shown in FIG. 15, which is otherwise closely similar to FIG. 14, the boom is pivoted at its base upon a pivot pin 135 mounted in any suitable manner on a base 25*a*. The pivoting arrangement allows the boom 15*a* to swing horizontally to adjust somewhat to longitudinal movement of the quadrupedally exercising user of the apparatus. At the same time the support belt 19 is attached to a ring 137 which may slide over the outer end of the boom 15*a* which, to facilitate such sliding, has been made to have a round configuration 139 rather than the rectangular configuration shown in the preceding drawings. The advantage of the arrangement is that if the one using the apparatus either speeds up or slows down on the treads as shown in previous figures, they will either progress forwardly on the treads or be carried rearwardly upon the treads, and as they progress away from directly under the stationary boom, will tend to be lifted upwardly by the effectively shortened suspension means and belt so that the user looses firm contact with the tread and may even swing momentarily in the air above the treads. With the arrangement shown in FIG. 15, however, there is at least some adjustment possible as the boom 15*a* and the ring 137 on the cylindrical section 139 of the end of the boom swings or slides to follow the user's movement. A desirable short adjustment range for the suspension belt, while still providing a reliable suspension, is therefore attained.

Figure 16:
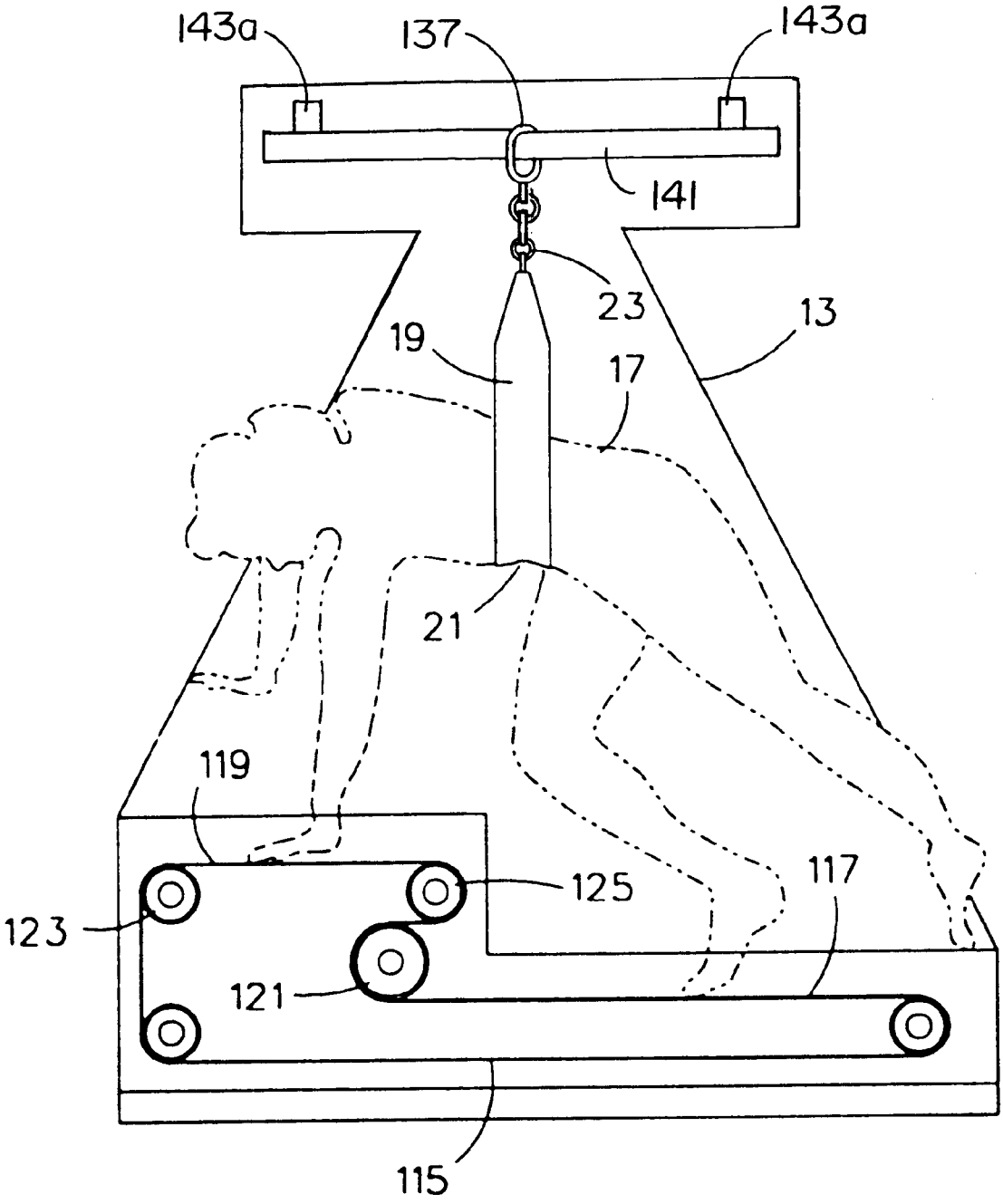
FIG. 16 is a diagrammatic side view of an embodiment of the invention having a slightly rearwardly and upwardly inclined slide bar to which the supporting belt is slideably secured to allow limited longitudinal adjustment of said belt.

FIG. 16 shows an alternative embodiment of the invention, where instead of a swinging boom 15*a* as shown in FIG. 15 there is instead a slightly inclined transverse supporting bar 141 suspended longitudinally over the treads from two brackets 143*a* and 143*b* at either end of such slightly inclined bar. Since a slow quadruped will tend to be carried backwardly on the apparatus, the longitudinal bar 141 is preferably slightly inclined upwardly to the rear so there is more resistance to movement to the rear than forwardly. The belt 19 is as in FIG. 15 supported from the bar 141 by a sliding ring 137 similar to that shown on the boom 15*a* in FIG. 15, but in FIG. 16 slidable along the supporting bar 141 to accommodate longitudinal movement of the user of the quadruped exercising apparatus of the invention. As will be seen, the side support plate 13 is in FIG. 16 also extended laterally along the top as extension 13*a* to accommodate the two brackets 143*a* and 143*b* on lateral extensions 13*a* of support plate 13.

The use of the two alternative suspensions of the quadruped exerciser shown in FIGS. 15 and 16 provide considerably more flexibility in partially supporting the user of the apparatus while not lifting such user from their feet if the apparatus carries them beyond their normal limits of movement due to momentary tiredness, tripping or the like particularly in or on a powered apparatus. It should also be understood that while it is preferred to use the belt support to take a certain degree of stress from the joints of the user, that it is not necessary to use such belt arrangement either in the form shown in FIGS. 1, 2, 3, 13, 14 or in FIG. 15 or FIG. 16 as the apparatus of the invention can perfectly well be used without the belt support especially by young vigorous, athletically inclined adults.

It will be understood from the foregoing description that a very effective structure for an apparatus for exercising the human body by means of a quadrupedal motion has been provided by the present inventor. Various ways of implementing the concept of the invention into specific embodiments have been shown. Furthermore, other embodiments of the invention are possible.

One very desirable arrangement would be to have a range of adjustment whereby the hand treads could be brought upward a sufficient distance so that the position of the hand treads would be essentially adjacent to the body forming a bipedal stance rather than the position of the hand treads being at the front end of the body in a quadruped stance. In such an arrangement, modifications in the tread surface would also be desirable so that instead of having the hand "walk" on the surface of the tread, the hand would grasp handholds on the surface of the tread and either pull the tread to the rear or be moved with the tread by a motor to the rear. In manual operation, it would be desirable to incorporate a resistance on the tread thereby increasing the exercise value of pulling the tread while the legs are walking forward on the foot tread. One way that the hand treads could be brought into a semi or completely upright position would be to have a series of curved grooves allowing the entire hand support to be raised upwardly. Alternatively, the entire hand construction could be mounted upon a lever arrangement which could be brought to any position from basically level with the rear foot tread to vertical with respect to the rear foot tread. In this way, the apparatus can be made convertible from a quadrupedal exercise device to a bipedal exercise device and thereby add to its versatility.

For example, in a quadrupedal exercise mode, the device is particularly useful for children and young people, as well as persons who require a relatively great amount of exercise with as little strain as possible. While in a bipedal mode, the apparatus is more useful for those adults who merely wish to walk or run in a bipedal mode rather than being placed in what may be a rather unusual and possibly awkward position. However, as indicated above, the fact that the apparatus is arranged so that the foot treads are lower than the hand treads, so that the body of the user is brought substantially into a horizontal position or even somewhat greater than a horizontal position, is sufficient to make the apparatus comfortable for at least the normally athletically inclined person. It will also be recognized that the apparatus of the invention may be made in a number of other embodiments, some of which have been described in the foregoing description. However, it will be readily recognized that the principal important element of the invention is to provide at least two separate treads, one of which takes a higher position than the other, and can be adjusted so that when a human assumes a quadrupedal stance upon the two treads, the body of the person will be substantially horizontal or somewhat greater than horizontal rather than otherwise. As pointed out above, it is convenient to have the hand treads divided into two separate treads, not only because they are spaced fairly widely in accordance with the fairly wide spacing of the shoulders of the human body, but also so that the two hands may operate substantially independently. So far as taking a walking stance is concerned, it is advantageous to move the hands in a coordinated manner with the feet so that the speed of all the treads should be about the same. While individual motors have been shown in the diagrammatic view of FIG. 2 for operation of the treads where motor operation is used, it will be understood also that various coordinated tread operating systems may be used in which only one motor may be necessary, as might appear in FIG. 13. The motors may be electric, hydraulic or of some other suitable type.

In operation or use of the apparatus shown, the height of the hand treads and of the foot tread will be adjusted to the particular anatomy of the individual who will be using the apparatus, so that the person taking a quadrupedal stance will have their body held substantially in a horizontal position or slightly greater than horizontal, designated as the "angle of comfort," and will then take coordinated steps on the hand treads as well as the foot treads which would, if they were on a natural surface, cause them to move along in a coordinated manner in a quadrupedal stance.

It will be understood that while a particularly effective apparatus has been shown in the accompanying drawings and claimed in the accompanying claims to practice this sort of exercise, that various other arrangements to effect a similar exercise routine could be conceivably constructed. For example, rather than having a bipartite endless tread surface, a track for quadrupedal exercise locomotion could be constructed having a two-level surface in which the feet of the user would progress along one level in the center and the hands of the user supporting the upper portion of the body could progress along a higher level, the two levels being coordinated such that when the user is progressing in a quadrupedal pace along the track, the body of the user is disposed substantially horizontally. The track could be constructed either by having a simple trench provided in the surface of the ground having a depth sufficient so that the legs would be brought to a depth which would match the hands progressing along the surface of the ground, or as an alternative, a completely depressed track could be provided in which there are two levels, one for the legs and one for the hands. As a still further alternative, the legs could progress along the normal surface of the earth and the hands could progress along two built-up portions beside the legs. In a similar manner, an endless tread could be constructed having two levels, the lower level for the feet and the upper level for the hands, the two levels again being spaced a distance apart so that the body would assume essentially a horizontal position during the exercise (see FIG. 13). As a still further embodiment, two separate endless treads could be arranged to run past a point at which the user was to be exercising, the upper tread which would be in a bipartite form with one half on each side being at a level suitable for the hands in a quadrupedal exercise stance and the inside tread being at a level suitable for supporting the feet in the quadrupedal exercise stance.

Exercise as described, therefore, can be practiced in several manners other than with the exact apparatus described in this application for patent. Furthermore, no matter how the particular quadrupedal walking or running is effected, the one exercising is automatically obtaining a very thorough, all-inclusive exercise of many body parts with very little strain to any given part, since the weight of the user is distributed over four support points rather than the two support points normally used in bipedal running and walking. Consequently, the quadrupedal exercise mode is particularly suitable for persons who might otherwise injure themselves due to a continuous repetitive pounding upon a track or the like. Furthermore, the use of the support belt about the midriff of the user in the preferred embodiment of the invention relieves some of the weight from the hands and feet of the user and also stabilizes the position of the user with respect to the moving treads.

The present inventor, therefore, has provided not only a new and effective apparatus for providing a completely new and unusually effective exercise of the body parts, but has also developed a new method of exercising which can be effected in various ways, including the use of the particular apparatus shown and described in this application for patent. Running or walking in a quadrupedal stance has not been unknown to children who may gain considerable pleasure by pretending they are animals. Such a mode of movement provides unexpected benefits to the physiology of the human animal with respect to exercise of the muscles in a persistent yet gentle exercise mode. There is also a certain satisfaction in the movement once it is established, which satisfaction can be attributed only to some atavistic memory of ancient four-legged movement, even before the evolution of our ancestors into forms adapted for progression from branch to branch in the trees.

The angle of comfort, i.e. the angle at which comfortable quadrupedal locomotion along a track, treadmill or other arrangement for quadrupedal movement of humans is effected, is from approximately parallel to horizontal to not more than about fifteen degrees from parallel to horizontal in a heads-up position. If the angle of the spine is less than this and the hips are elevated significantly more than the shoulders, the position will be uncomfortable. If the angle is greater than this, the walking motion should be considered to be not quadrupedal exercise, but bipedal exercise and may also be desirable, especially if the apparatus is designed for interconvertibility.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. An exercise apparatus comprising:

(a) a base, (b) forward and rear rotatable treadmill-type movable body support means mounted upon said base, the movable support body means having upper body support surfaces, (c) said forward treadmill means being positionable with its upper body supporting surface at a more elevated position than the upper body supporting surface of the rear treadmill means by a factor at least approximately equal to the difference in length between a user's arms and legs, and (d) the upper body support surfaces of the forward and rear treadmill means being adapted for positioning at angles inclined in the same direction.

2. An exercise apparatus in accordance with claim 1 wherein the forward treadmill means comprises two spaced-apart treadmills positioned substantially parallel to each other.

3. An exercise apparatus in accordance with claim 2 wherein the rear treadmill means partially overlaps the forward treadmill means extending partly between such forward treadmill means, but at a lower level.

4. The exercise apparatus in accordance with claim 2 wherein at least one of said treadmill means is powered for rotation.

5. An exercise apparatus in accordance with claim 4 wherein each treadmill means is powered for rotation.

6. The exercise apparatus in accordance with claim 2 additionally comprising a support means contiguous with the base with a supporting member positioned above a point approximately between the two treadmill means, said support being provided with a body attachment means for restraining a human body positioned more or less horizontally with the arms and legs resting respectively upon the forward and rear treadmill.

7. An exercising apparatus in accordance with claim 6 wherein the body attachment means is supported from a longitudinally variable support location.

8. An exercise apparatus in accordance with claim 7 wherein the body attachment means is slidable on a bar arrangement to provide longitudinal adjustment.

9. An exercising apparatus in accordance with claim 5 in which the treadmill apparatus are adjustable for height to adjust for different dimensions of human bodies.

10. An exercise apparatus in accordance with claim 9 wherein at least one of the treadmills is adjustable with respect to inclination to adjust the exercise obtained during use.

11. An exercise apparatus in accordance with claim 6 wherein the treadmill means are adjustable with respect to relative height and inclination to provide for use by various persons with various requirements for degrees of exercise.

12. A method of exercising comprising progressing along a supporting surface in a quadrupedal mode with the feet of the exerciser supported during quadrupedal movement at a lower level than the hands of the exerciser such that the angle of the body of the exerciser with respect to horizontal is approximately horizontal to fifteen degrees from horizontal in a head elevated mode.

13. A method of exercising in accordance with claim 12 wherein both the feet and the arms are moved with a stepping motion along endless rotating treadmill means.

14. A method of exercising in accordance with claim 12 in which the feet and hands of the exerciser progress along a two-level surface in which the feet are moved upon a lower surface and the hands are moved along an upper surface, the distance between the two surfaces and the positions of the hands and feet vertically with respect to each other being approximately the difference in the length of the arms and the legs of the exerciser.

15. A method of exercising in accordance with claim 14 in which the quadrupedal movement is along a track having two surface levels, the lower of which surface levels accommodates the feet and the upper of which surface levels accommodates the hands of the exerciser.

16. A method of exercising in accordance with claim 14 in which the two surfaces comprise two separate moving treadmills.

17. A method of exercising in accordance with claim 13 in which the feet and hands of the exerciser are moved along two surfaces which comprise moving differentially elevated surfaces of a single moving treadmill means.

18. A method of exercising in accordance with claim 16 wherein the moving treadmills are moved by rotating motor means interconnected with the treadmills.

19. An exercise apparatus comprising:

(a) a base, (b) forward and rear rotatable treadmill-type moving support means mounted upon said base, (c) said forward treadmill means being positioned at a more elevated position than the rear treadmill means by a factor approximately equal to the difference in length between the average person's arms and legs and wherein the forward treadmill means comprises two spaced-apart treadmills positioned substantially parallel to each other.

20. An exercise apparatus in accordance with claim 2 wherein the rear treadmill means partially overlaps the forward treadmill means extending partly between such forward treadmill means, but at a lower level.

21. A treadmill-type exercising apparatus comprising:

(a) a forward treadmill support surface adapted for moving support of the hands of a user, (b) a rearward treadmill support surface adapted for moving support of the feet of the user, (c) each treadmill body support surface having a contact area designed for normal contact with the hands or feet of the user, (d) the forward treadmill body support contact surface being positioned at a greater elevation than the rear treadmill body support contact surface substantially at least equal to the difference in length of the arms and legs of the user.

22. A treadmill-type exercising apparatus in accordance with claim 21 wherein the difference in elevation of the forward and rear treadmill support surfaces is greater than the difference in length of the arms and legs of the user.

* * * * *